US005662823A

United States Patent [19]

Claar et al.

[11] Patent Number: 5,662,823

[45] Date of Patent: Sep. 2, 1997

[54] IMPACT PAD

[75] Inventors: Brian P. Claar, Oxford; Jeffrey W. Weyant, Downington, both of Pa.

[73] Assignee: A. P. Green Industries, Inc., Mexico, Mo.

[21] Appl. No.: 582,723

[22] Filed: Jan. 4, 1996

[51] Int. Cl.[6] ..... C21B 3/04

[52] U.S. Cl. ..... 222/594; 266/275

[58] Field of Search ..... 222/594, 591, 222/590; 266/227, 229, 275, 236

[56] References Cited

U.S. PATENT DOCUMENTS

| | | | |
|---|---|---|---|
| 2,874,427 | 2/1959 | Sterick | 22/139 |
| 3,195,853 | 7/1965 | Ferree | 249/206 |
| 4,209,162 | 6/1980 | Petiau | 249/206 |
| 4,744,544 | 5/1988 | LaBate et al. | 266/100 |
| 5,072,916 | 12/1991 | Soofi | 266/275 |
| 5,110,096 | 5/1992 | Zacharias | 266/227 |
| 5,131,635 | 7/1992 | Soofi | 266/275 |
| 5,133,535 | 7/1992 | Soofi | 266/275 |
| 5,160,480 | 11/1992 | Vassilicos | 266/275 |
| 5,169,591 | 12/1992 | Schmidt et al. | 266/275 |
| 5,188,796 | 2/1993 | Soofi | 266/275 |
| 5,196,051 | 3/1993 | Heaslip et al. | 75/582 |
| 5,391,348 | 2/1995 | Soofi | 266/275 |

*Primary Examiner*—Scott Kastler

*Attorney, Agent, or Firm*—Senniger, Powers, Leavitt & Roedel

[57] ABSTRACT

An impact pad for use on the bottom of a vessel into which molten metal is poured for suppressing turbulence of the molten metal. The impact pad includes a central formation having a center and an outer circular periphery and diminishing in height form the center to the outer circular periphery and an outer annular formation surrounding the central formation and having an outer peripheral surface and an inner edge at the outer circular periphery of the central portion and an upper surface flaring outwardly from the inner edge. The outer annular formation has a plurality of channels formed therein extending radially outward from the inner edge.

15 Claims, 2 Drawing Sheets

IMPACT PAD

BRIEF SUMMARY OF THE INVENTION

This invention relates generally to an impact pad such as used on the bottom of a vessel into which molten metal is poured, such as a vessel of the type referred to as a tundish.

While the invention is especially directed to an impact pad for use in a tundish, it will be understood that the principles of the invention may be applicable to an impact pad for use in other environments.

Molten metal is typically poured into the top of a tundish at one point and exits from the bottom of the vessel at another point. The impurities within the molten metal tend to float to the top of the vessel and form a slag layer when the molten metal is nonturbulent. The impact of the molten metal stream upon the bottom of the vessel tends to agitate and cause turbulence in the molten metal, thus causing migration of the top slag layer and impurities into the lower portion of the vessel where the molten metal exits the vessel. Accordingly, there is a need for an impact pad that disperses the molten metal stream evenly throughout the tundish without creating undue turbulence within the tundish, to prevent impurities from exiting the tundish.

Accordingly, among the several objects of the invention may be noted the provision of an impact pad of the class described particularly for Use on the bottom of a tundish although possibly useful on the bottom of other vessels into which molten metal is poured, the pad being effective to suppress turbulence of the molten metal in the tundish and also to prevent erosion of the bottom of the tundish; and the provision of such an impact pad having a relatively long life for the environment in which it is used while being of relatively compact size and cost.

In general, an impact pad of this invention is for use on the bottom of a vessel into which molten metal is poured for suppressing turbulence of the molten metal. The impact pad has a central formation having a center and an outer circular periphery and diminishing in height from the center to the outer circular periphery and an outer annular formation surrounding said central formation and having an outer peripheral surface and an inner edge at the outer circular periphery of the central formation and an upper surface flaring outwardly from the inner edge. The outer annular formation has a plurality of channels formed therein extending radially outward from the inner edge. The channels extend down from the upper surface.

Other objects and features will be in part apparent and in part pointed out hereinafter.

BRIEF DESCRIPTION OF THE DRAWINGS

Corresponding reference characters indicate corresponding parts throughout several view of the drawings.

DETAILED DESCRIPTION

Figure 4:
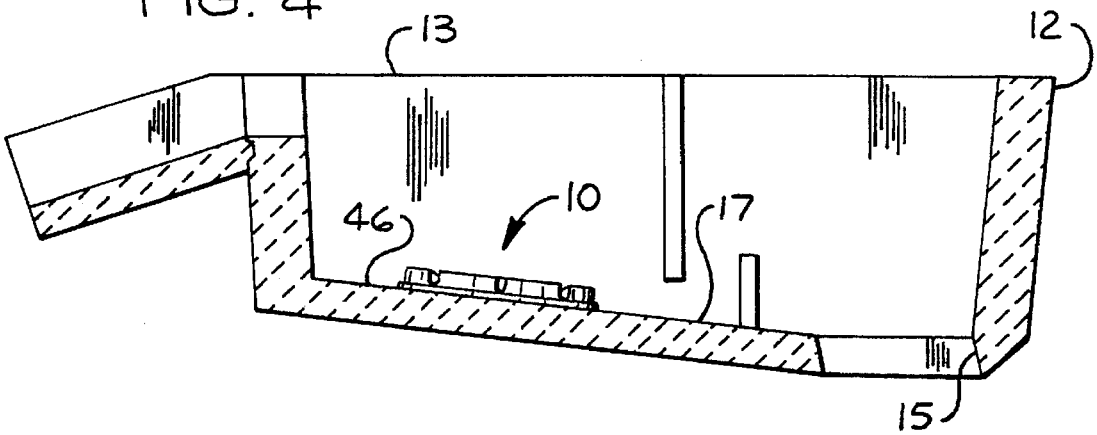
FIG. 4 is a view in section showing the pad as used in a tundish.
Figure 5:
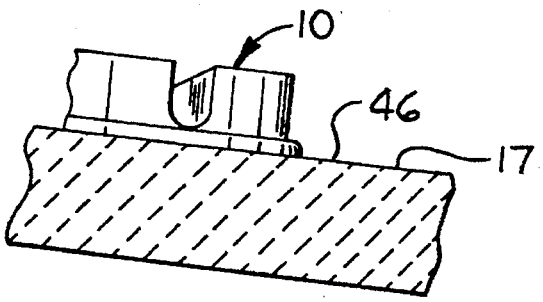
FIG. 5 is an enlarged fragmentary view of the pad and tundish of FIG. 4.

Referring to the drawings, an impact pad of this invention is indicated in its entirety by the reference number 10, and shown in FIG. 4 in use on the bottom of a tundish 12. Molten metal is poured into the tundish 12 through its top 13 to impact on the pad 10, which functions to suppress turbulence of the molten metal in the tundish and prevents erosion of the bottom of the tundish. The latter has an opening such as indicated at 15 in the bottom for exit of the molten metal, the bottom being inclined as shown for flow of the molten metal down from the region of the pad 10 to the opening.

Figure 1:
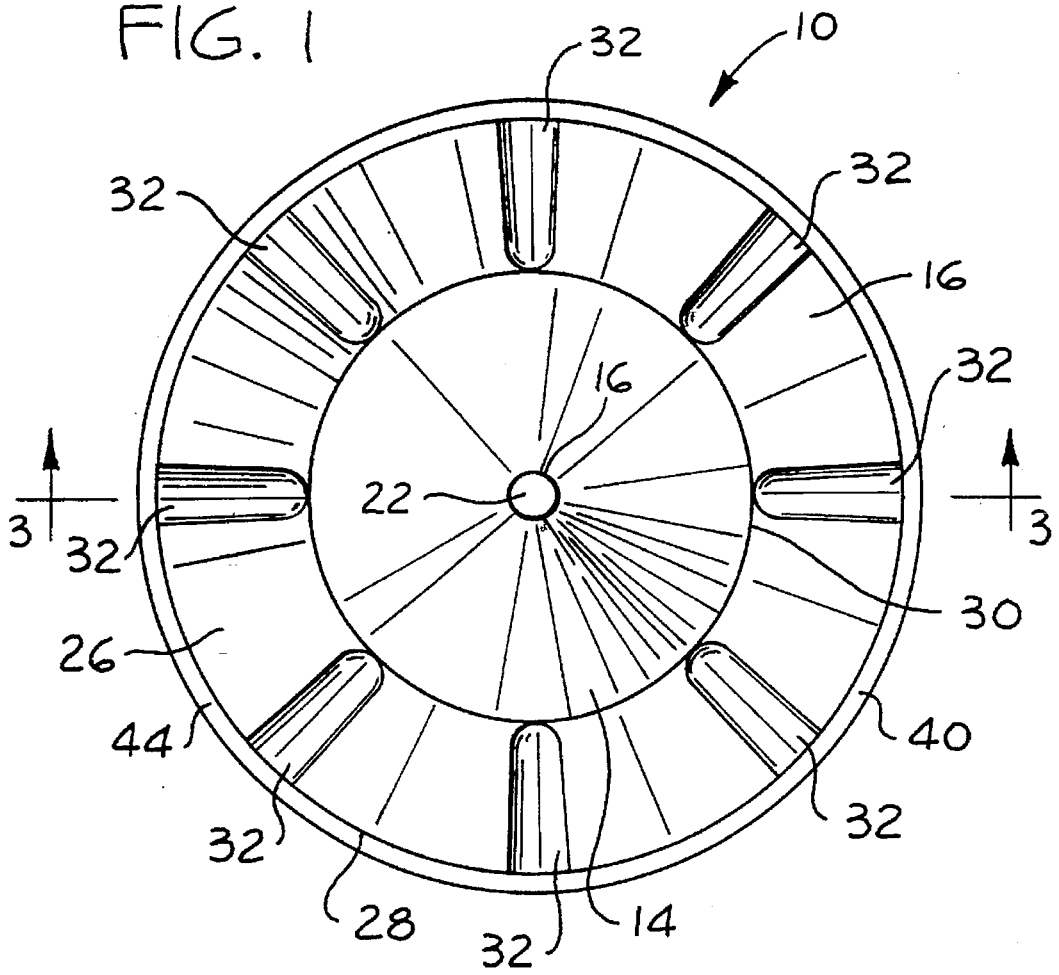
FIG. 1 is a view in plan of the pad.
Figure 2:
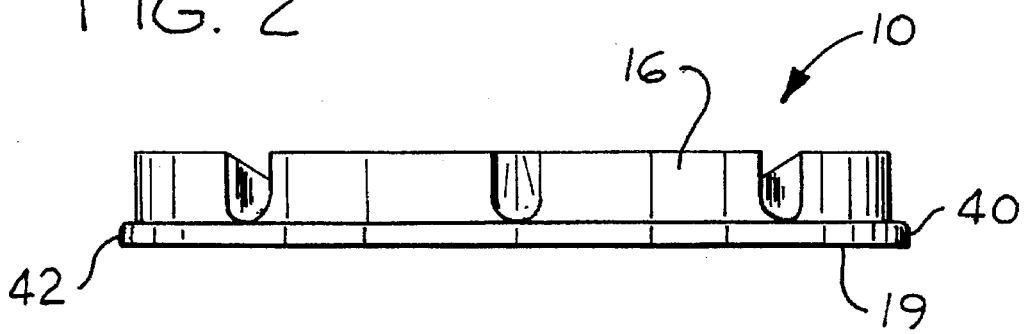
FIG. 2 is a view in side elevation of the pad.

The impact pad 10, as illustrated in FIG. 1, is of circular shape in plan, with a relatively low profile, having a central formation generally designated 14 shown as being generally of conical convex shape, and more particularly of frustoconical shape, and an annular formation generally designated 16 surrounding the central formation. Being generally of conical convex shape, the central formation 14 has a center 18 at the top and an outer circular periphery 20, diminishing in height from the center to the outer periphery. The conical surface of the central formation 14 is of relatively low slope, being inclined to the horizontal, i.e. inclined to the plane of the bottom of the central formation at an angle of the order of 15°–20°. With the surface of the central formation 14 so inclined, molten metal pouring into the tundish 12 and flowing down the surface of the central formation is smoothly and evenly dispersed. In a physical embodiment of the pad 10, the circular outer periphery 20 of the central formation 14 is 12 inches in diameter, the altitude of the central formation, i.e. the distance from the plane of the outer circular periphery 20 to the top 22 of the central formation is 2 inches, and the top is flat in a plane parallel to the plane of the circular outer periphery 20 and of circular outline with a diameter of approximately four inches.

Figure 3:
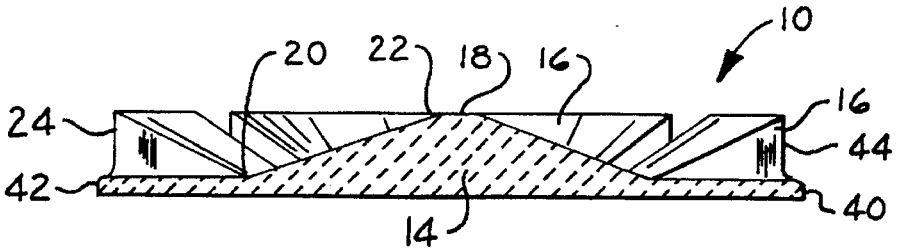
FIG. 3 is view in section on line 3—3 of FIG. 1.

The outer annular formation 16, surrounding the central formation or cone 14, is constituted by a wall having an outer peripheral surface 24 extending up from the plane of the circular outer periphery 20 of the cone 14 perpendicular to said plane, a sloping upper surface 26 of inverted conical concave form having an outer circular edge 28 at the top of the outer peripheral surface 24, and an inner circular edge 30 which, as appears in FIGS. 1 and 3, is coincident with the circular outer periphery 20 of the cone 14. The upper surface 26 of the outer annular formation flares upwardly and outwardly from the inner edge 30 thereof (the outer periphery 20 of the cone 14) being inclined at an angle of the order of 25°–30° to the plane of the bottom of the central formation 14. In a physical embodiment of the pad, the height of the outer peripheral surface of the annular formation 16 is 2 inches.

The annular formation 16 has a plurality of channels 32 formed therein extending radially outward from its inner edge 30. These channels are generally U-shaped open-top channels increasing in width from the inner edge 30 of the annular formation 16 to the outer peripheral surface 24 thereof. They do not penetrate the outer circular periphery 20 of the central formation 14, thus allowing a smooth, guided flow of the molten metal to prevent the occurrence of turbulence in the molten metal within the vessel 12. Following impact of the molten metal upon the central formation or cone 14, the molten metal flows radially outwardly through the channels 32 in the annular formation 16 and along the bottom surface 17 of the tundish 12 to the exit opening 15 in the bottom of the vessel. The channels 32 are spaced at equal intervals around the annular formation 16. As shown in FIG. 1, there are eight channels 32, spaced at 45° around the pad.

The central formation or cone 14 and the outer annular formation or wall 16 are integrally formed on a relatively thin circular flat-bottomed base 40. The latter is of larger diameter than the outer peripheral surface 24 of the wall 16 so as to have a rim 42 extending outwardly beyond the outer peripheral surface 24 of the annular formation. The impact pad 10 is placed in the tundish 12 with the flat bottom 19 of the circular base 40 engaging the bottom surface 17 of the vessel. The rim 42 has an upper surface 44 over which a liner 46 (see FIG. 4) is placed to hold the impact pad 10 in place within the vessel 12 during the pouring of the molten metal.

The circular base 40, central formation 14 and annular formation 16 are preferably integrally formed from a refractory material. In the above-noted embodiment, the diameter of the circular base 40 is 21 inches, the diameter of the outer periphery of the central formation 14 is 12 inches and the diameter of the outside surface 24 of the annular formation 16 is 20 inches. The diameter of the central formation 14 is selected to best match the diameter of the molten metal stream entering the tundish 12 and allow for the most efficient dispersion of the stream.

FIG. 4 shows the impact pad 10 in place in a tundish 12. The impact pad 10 is placed on the bottom 17 of the tundish 12 at the location where the molten metal will be poured. The liner 46 is formed from alumina silica, or other suitable material which is sprayed over the bottom surface 17 of the tundish 12 and over the rim 42 of the circular base 40 of the impact pad 10. The liner 46 holds the impact pad 10 in a fixed position within the tundish 12 and prevents the impact pad from floating out of position during use.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. An impact pad for use on the bottom of a vessel into which molten metal is poured for suppressing turbulence of the molten metal; said impact pad having a central formation having a center and an outer circular periphery and diminishing in height from the center to said outer circular periphery and an outer annular formation surrounding said central formation and having an outer peripheral surface and an inner edge at the outer circular periphery of the central portion and an upper surface flaring outwardly from said inner edge, said outer annular formation having a plurality of channels formed therein extending radially outward from said inner edge, said channels extending down from said upper surface.

2. An impact pad as set forth in claim 1 having a flat-bottomed circular base, said central formation and said annular formation being integral with said base, said circular base having a rim extending outwardly beyond the outer peripheral surface of the annular formation.

3. An impact pad as set forth in claim 1 wherein said channels are generally U-shaped open-top channels which increase in width from the inner edge of the annular formation to the outer peripheral surface thereof.

4. An impact pad as set forth in claim 1 wherein the channels are spaced at equal intervals around the annular formation.

5. An impact pad as set forth in claim 1 wherein said central formation is generally of conical shape.

6. An impact pad as set forth in claim 5 wherein said central formation has a conical surface inclined about 15°–20° with respect to a plane containing the outer circular periphery of the central formation.

7. An impact pad as set forth in claim 5 wherein said annular formation has a surface of inverted conical shape inclined about 25°–30° with respect to a plane containing the inner edge of the annular formation.

8. An impact pad as set forth in claim 2 wherein said central formation, the annular formation and the circular base are integrally formed from a refractory material.

9. A vessel for molten metal having a bottom and an impact pad on the bottom, said impact pad having a central formation having a center and an outer circular periphery and diminishing in height from the center to said outer circular periphery and an outer annular formation surrounding said central formation and having an outer peripheral surface and an inner edge at the outer circular periphery of the central portion and an upper surface flaring outwardly from said inner edge, said outer annular formation having a plurality of channels formed therein extending radially outward from said inner edge, said channels extending down from said upper surface, and a flat bottomed circular base, said central formation and said annular formation being integral with said base, said circular base having a rim extending outwardly beyond the outer peripheral surface of the annular formation, and a liner overlying the rim of the circular base and the bottom surface of the vessel whereby the impact pad is held in a stationary position in the vessel.

10. A vessel as set forth in claim 9 wherein said channels of the impact pad are generally U-shaped open-top channels which increase in width from the inner edge of the annular formation to the outer peripheral surface thereof.

11. A vessel as set forth in claim 9 wherein said channels of the impact pad are spaced at equal intervals around the annular formation.

12. A vessel as set forth in claim 9 wherein said central formation is generally conical shape.

13. An vessel as set forth in claim 12 wherein said central formation has a conical upper surface inclined about 15°–20° with respect to a plane containing the outer circular periphery of the central formation.

14. An impact pad as set forth in claim 12 wherein said annular formation has a surface of inverted conical shape inclined about 25°–30° with respect to a plane containing the inner edge of the annular formation.

15. A vessel as set forth in claim 9 wherein said central formation, the annular formation and the circular base of the impact pad are integrally formed from a refractory material.

* * * * *